US008403672B2

(12) United States Patent
Odorisio

(10) Patent No.: US 8,403,672 B2
(45) Date of Patent: Mar. 26, 2013

(54) TRAINING TARGET FOR AN ELECTRONICALLY CONTROLLED WEAPON

(76) Inventor: Tim Odorisio, Omaha, NE (US)

( * ) Notice: Subject to any disclaimer, the term of this patent is extended or adjusted under 35 U.S.C. 154(b) by 388 days.

(21) Appl. No.: 12/589,292

(22) Filed: Oct. 21, 2009

(65) Prior Publication Data

US 2011/0091840 A1 Apr. 21, 2011

(51) Int. Cl.
*F41G 3/26* (2006.01)

(52) U.S. Cl. ..... 434/19; 434/12

(58) Field of Classification Search ..... 434/6–29; 273/148 R, 148 A, 373, 378; 40/122; 361/232; 324/72; 42/108; 89/1.11; 463/1, 2, 5, 30, 463/31, 53

See application file for complete search history.

(56) References Cited

U.S. PATENT DOCUMENTS 3,387,842 A 6/1968 Edgar
3,573,868 A 4/1971 Giannetti
3,838,856 A 10/1974 Taheya et al.
3,847,396 A 11/1974 Ashford
3,964,178 A 6/1976 Marshall et al.
4,086,711 A 5/1978 Gammarino et al.
4,097,156 A 6/1978 Garber et al.
4,137,651 A 2/1979 Pardes et al.
4,163,328 A 8/1979 Sherburne et al.
4,163,557 A 8/1979 McLellan
4,229,009 A 10/1980 Ohta
4,266,776 A 5/1981 Goldfarb
4,335,880 A 6/1982 Meyer et al.
4,364,562 A 12/1982 White et al.
4,439,156 A 3/1984 Marshall et al.
4,482,156 A 11/1984 Karlsson
4,822,040 A 4/1989 Raditic
4,854,595 A 8/1989 Eichweber
4,887,583 A 12/1989 Lin
4,932,657 A 6/1990 Hailer et al.
4,946,159 A 8/1990 Jones
5,095,433 A * 3/1992 Botarelli et al. ..... 273/372
5,232,217 A 8/1993 Cota et al.
5,518,251 A 5/1996 Liu
5,625,525 A 4/1997 Coakley et al.
5,669,610 A 9/1997 Salyers
5,816,579 A 10/1998 Broussard et al.
5,962,806 A 10/1999 Coakley et al.
5,984,788 A 11/1999 Lebensfeld et al.

(Continued)

OTHER PUBLICATIONS stun1.pdf—web document rettrieved from <http://www.womenonguard.com/-strse-290/TASER-Practice-Target/Detail.bok> on [Dec. 12, 2012 10:26:38 AM]. Confirmed as available on Mar. 5, 2009 via webarchive.org <http://web.archive.org/web/20090305225636/http://www.womenonguard.com/-strse-290/TASER-Practice-Target/Detail.bok[Dec. 12, 2012 10:26:38 AM]>.*

(Continued)

*Primary Examiner* — Timothy A Musselman
(74) *Attorney, Agent, or Firm* — Dennis L. Thomte; Thomte Patent Law Office LLC

(57) ABSTRACT

A training target is described for electronically controlled devices or weapons such as a Taser® gun. The target includes a front sheet having an electrically conductive sheet positioned at the back side thereof with the target being in the shape of a substantially life-size human being. The image of the human being is printed on the front face of the front sheet. The sheets may be reversed so that the image is printed on the electronically conductive sheet.

4 Claims, 4 Drawing Sheets

U.S. PATENT DOCUMENTS

| | | | | |
|---|---|---|---|---|
| 6,256,916 | B1 | 7/2001 | McNulty | |
| 6,269,726 | B1 | 8/2001 | McNulty, Sr. | |
| 6,942,486 | B2 | 9/2005 | Lvovskiy | |
| 6,966,775 | B1 | 11/2005 | Kendir et al. | |
| 7,001,182 | B2 | 2/2006 | Lazechi et al. | |
| 7,042,696 | B2 | 5/2006 | Smith et al. | |
| 7,075,770 | B1 | 7/2006 | Smith | |
| 7,111,559 | B1 | 9/2006 | MacLachlan | |
| 7,145,762 | B2 | 12/2006 | Nerheim | |
| 7,206,183 | B2 | 4/2007 | Sikes et al. | |
| 7,207,567 | B1 | 4/2007 | Brown | |
| 7,305,787 | B1 | 12/2007 | Stratbucker | |
| 7,314,007 | B2 | 1/2008 | Su | |
| 7,316,399 | B2 * | 1/2008 | Shaw et al. | 273/371 |
| 7,327,549 | B2 | 2/2008 | Smith et al. | |
| 7,421,933 | B1 | 9/2008 | Pearson | |
| 7,474,518 | B2 | 1/2009 | Rutz et al. | |
| 7,520,081 | B2 | 4/2009 | Kroll | |
| 2004/0046321 | A1 | 3/2004 | Karnofsky | |
| 2005/0118556 | A1 | 6/2005 | Watanabe et al. | |
| 2007/0020586 | A1 * | 1/2007 | Hull et al. | 434/16 |
| 2007/0079538 | A1 | 4/2007 | Smith et al. | |
| 2007/0122770 | A1 | 5/2007 | Swensen | |
| 2007/0188972 | A1 | 8/2007 | Nerheim et al. | |
| 2007/0297117 | A1 | 12/2007 | Elliott, Jr. | |
| 2008/0026346 | A1 | 1/2008 | Holmer et al. | |
| 2008/0108021 | A1 | 5/2008 | Slayton et al. | |
| 2008/0123240 | A1 | 5/2008 | Nerheim | |
| 2008/0194337 | A1 | 8/2008 | Hensel | |
| 2008/0204965 | A1 | 8/2008 | Brundula et al. | |
| 2008/0220397 | A1 | 9/2008 | Capone et al. | |
| 2008/0261727 | A1 | 10/2008 | Snyder | |
| 2009/0038497 | A1 | 2/2009 | Van Der Ploats et al. | |
| 2009/0119968 | A1 | 5/2009 | Lowell et al. | |
| 2009/0218769 | A1 * | 9/2009 | Krzewicki et al. | 273/374 |
| 2010/0225064 | A1 * | 9/2010 | Deatherage, Jr. | 273/405 |

OTHER PUBLICATIONS stun2.pdf—web document rettrieved from <http://www.stungunshq.com/taser-target-single.html> on [Dec. 12, 2012 10:16:32 AM]. Confirmed as available on Jun. 27, 2009 via webarchive.org <http://web.archive.org/web/20090627052537/http://www.stungunshq.com/taser-target-single.html[Dec. 12, 2012 10:16:32 AM]>.*

* cited by examiner

TRAINING TARGET FOR AN ELECTRONICALLY CONTROLLED WEAPON

BACKGROUND OF THE INVENTION

1. Field of the Invention

This invention relates to a practice target for a Taser® type gun or weapon and more particularly to a practice target which is in the shape of a human figure or being. Even more particularly, this invention relates to a practice target comprising a front sheet, having front and rear sides, with an electrically conductive sheet mounted on the back side thereof.

2. Description of the Related Art

Weapons that deliver electrified projectiles are used for self defense in law enforcement. A weapon that is extremely well known is the Taser® gun which fires two projectiles or darts from a hand-held device to deliver a stimulus signal to a person or animal. The projectiles remain tethered to a power supply in the hand-held device by a pair of insulated wires. In some cases, more than two darts may be fired from the weapon.

Prior to this invention, there were no effective targets which were available for training purposes for use with electronically controlled weapons sometimes called ECDs (electronically controlled devices). When training with an electronically controlled weapon, the weapon emits an electrical current through a tethered wire or wires that run to a pair of darts. The darts are the "bullet" that impacts the target. Once the darts are delivered, the marksman administers an electric pulse which transmits two tones back through the weapon. One of these tones will indicate a hit and the other tone indicates a miss. To the best of Applicant's belief, there is not a target for sale, marketed or patented that is compatible for use with an electronically controlled device or weapon. Currently, law enforcement agencies are using targets that do not have any type of conductivity or are using self-made targets made from over-the-counter (aluminum) strips, tape or glue. The targets presently available do not fairly represent a human being.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A training target device is provided for electronically controlled devices or weapons such as a Taser® gun with the weapon being capable of firing or shooting one or more tethered darts through which an electric current may be transmitted. The training target of this invention includes a front sheet having a front side and a back side with an electrically conductive sheet member positioned at the back side thereof. The front sheet has the image of a human being printed thereon. In the preferred embodiment, the electrically conductive sheet is comprised of a metal material such as silver, copper, gold, aluminum or a metal alloy comprised of platinum, titanium, chromium or cobalt. In the preferred embodiment, the front sheet is comprised of a paper material, a plastic material, a wood material, a fiber material or a fabric material. In the preferred embodiment, the sheets are flexible so that they may be rolled into a tube.

In the preferred embodiment, the front sheet is comprised of an upper sheet member and a lower sheet member and the electronically conductive sheet member is comprised of an upper sheet member and a lower sheet member. The upper sheet member of the front sheet member preferably has a life-size image of the upper portion of a human being appearing thereon with the lower sheet of the front sheet member having a life-size image of the lower portion of a human being appearing thereon. The images may be the front of a person or the back of the person.

In use, when the weapon is fired and then the electrical current therein is discharged, the circuitry of the weapon will indicate a tone which indicates to the person firing the weapon that the target has been hit with both darts.

It is therefore a principal object of the invention to provide an improved training target for an electronically controlled device or weapon.

A further object of the invention is to provide a training target of the type described which is life sized.

A further object of the invention is to provide a training target of the type described which includes a front sheet having an electrically conductive sheet mounted on the back side thereof with the front sheet displaying an image of a human being.

A further object of the invention is to provide a training target of the type described which may be comprised of a flexible material so as to be rolled into a tube for shipment.

A further object of the invention is to provide a training target for an electronically controlled device or weapon which provides the necessary feedback to the shooter to indicate that the shooter has hit the target.

A further object of the invention is to provide a training target for an electronically controlled device or weapon such as a Taser® gun.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
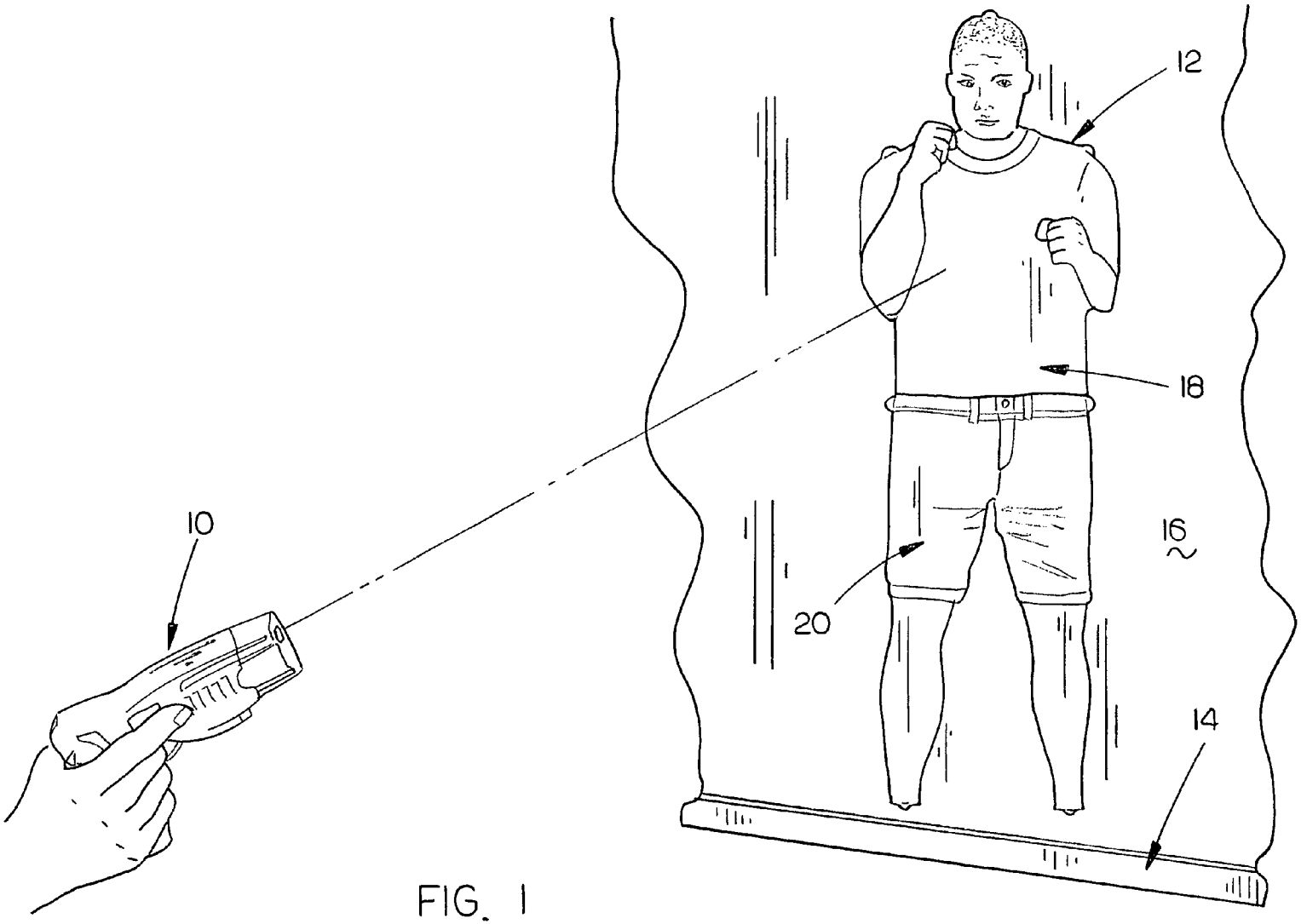
FIG. 1 is a perspective view of the target of this invention which illustrates the method by which it is used.
Figure 2:
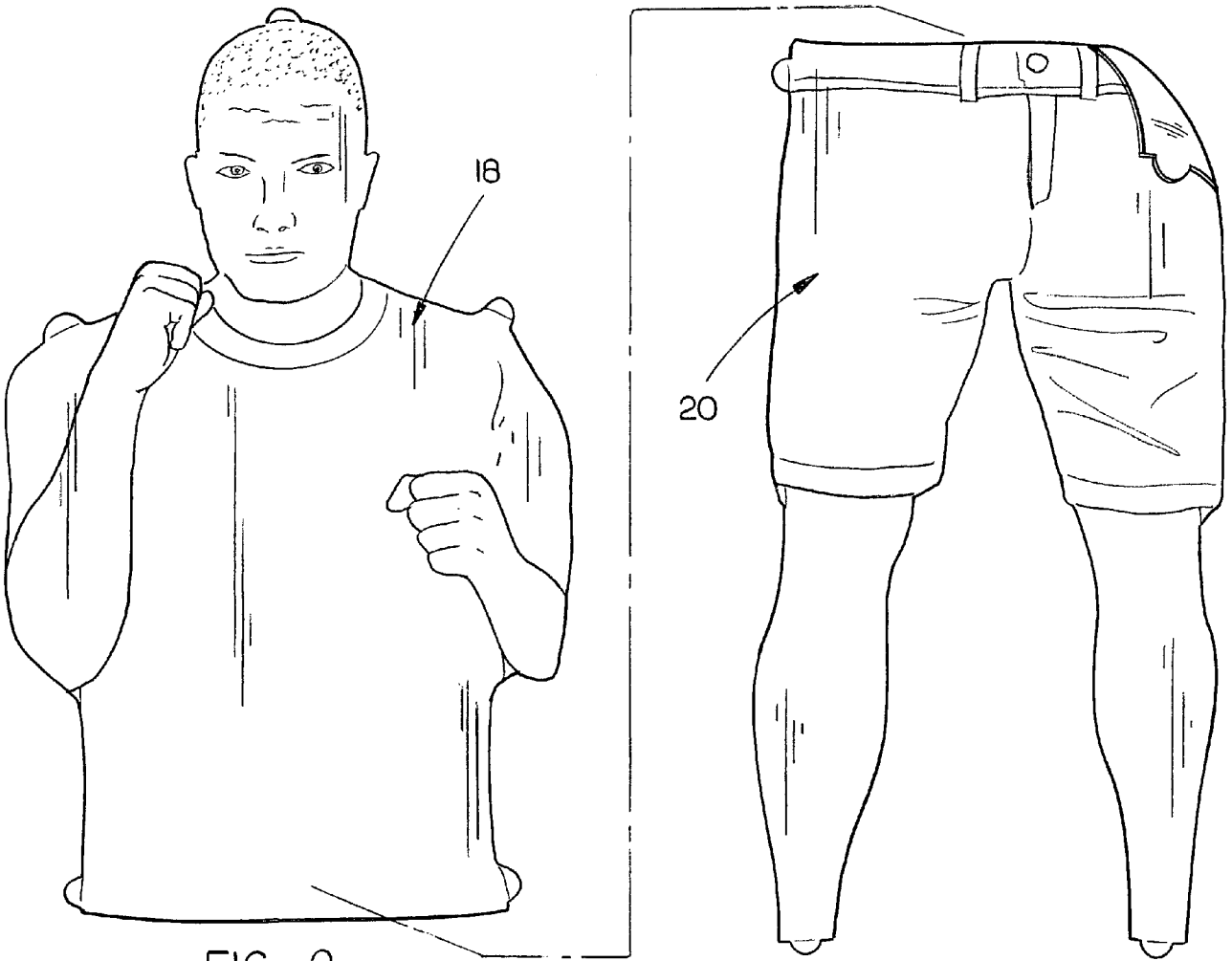
FIG. 2 is a front view of the upper and lower target members of the target.
Figure 3:
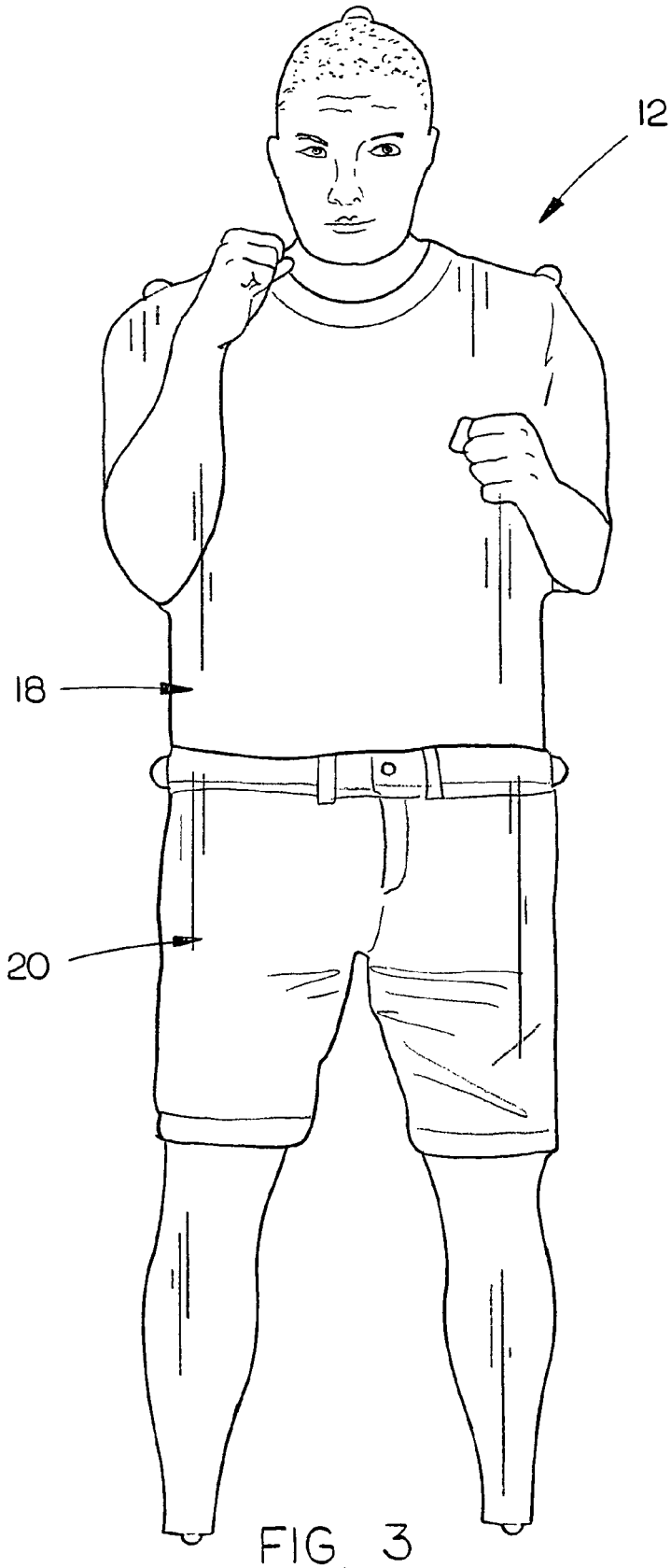
FIG. 3 is a front view of the target of this invention.
Figure 4:
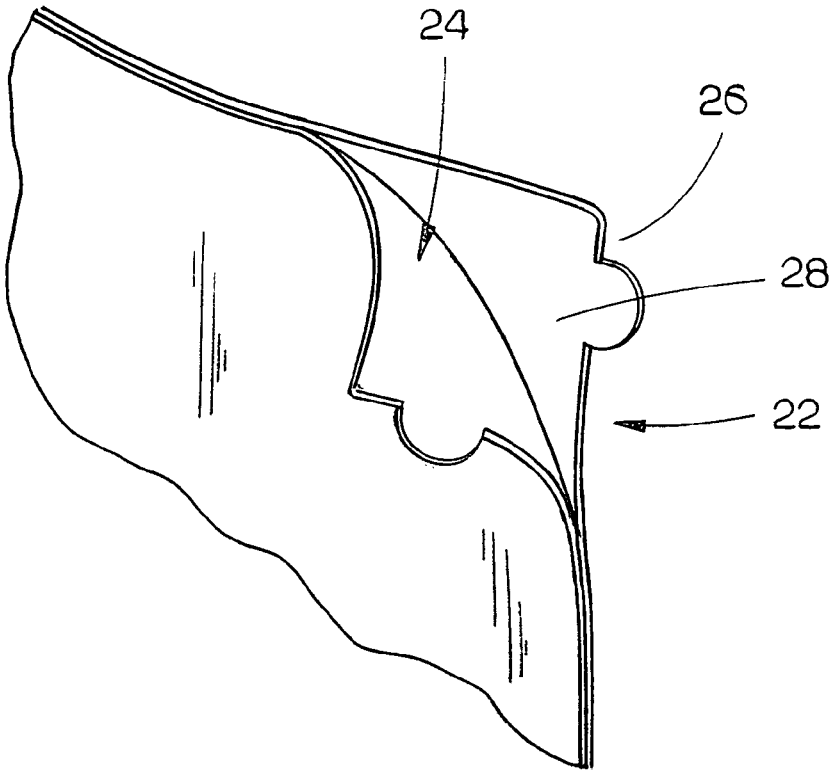
FIG. 4 is a partial perspective view of the front sheet and the electrically conductive sheet at the back side thereof.
Figure 5:
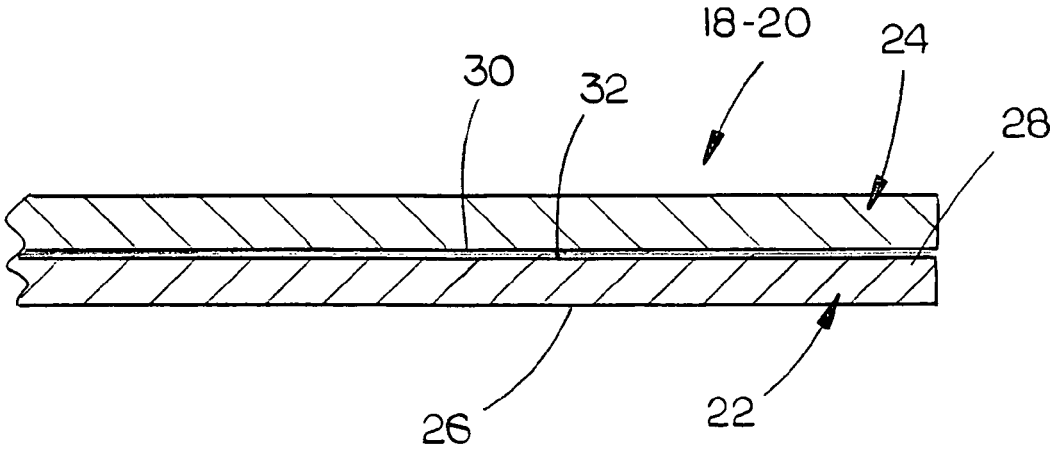
FIG. 5 is a partial sectional view of the front sheet and the electrically conductive sheet positioned at the back side thereof.

FIG. 1 illustrates an electronically controlled device or weapon 10 such as a Taser® gun shooting a round or one or more tethered darts into the target 12 of this invention. Normally the target 12 will be mounted on some sort of support or stand 14 having a supporting surface 16 thereon. The target 12 may be pinned, tacked or otherwise selectively removably secured to the supporting surface 16. Target 12 is preferably life sized and is preferably comprised of an upper target portion 18 and a lower target portion 20 as will be described in detail hereinafter.

Each of the target portions 18 and 20 are comprised of a front sheet 22 and an electrically conductive sheet 24 positioned at the back side of sheet 22. Front sheet 22 will be described as having a front side 26 and a back side 28. The front side 30 of sheet 24 is positioned at the back side 28 of sheet 22 and is preferably secured thereto by an adhesive 32. Preferably, the sheets 24 of target portions 18 and 20 are comprised of an electrically conductive metal material such as aluminum, copper, silver, gold or a metal alloy material such as platinum, titanium, chromium, or cobalt. Preferably, the front sheets 22 of target portions 18 and 20 are comprised of a paper material, a wood material, a plastic material, a fiber material or a fabric material. Preferably, the target portions 18 and 20 are each comprised of a flexible material so that they may be rolled into a tube for shipping purposes. The front side 26 of sheet 22 of target portion 18 has a substantially life-sized image or photo of the upper portion of a human figure printed thereon. The front side 26 of target portion 20 has a substantially life-sized image or photo of the lower portion of a human figure printed thereon. The images or photos may be the front or back sides of a human figure. When the target portions 18 and 20 are positioned on the supporting surface 16 of stand 14, the lower edge of target portion 18 is overlapped with the upper edge of target portion 20 so that the electrically conductive sheets 24 thereof are in electrical contact with each other through the sheets 22.

The target 12 could be of one-piece construction but preferably target 12 is comprised of the target portions 18 and 20 for fabrication, printing, assembly and shipping purposes.

Although the preferred embodiment of the invention is with the front sheets 22 having the image of a human being printed thereon, the sheets 22 and 24 may be reversed so that the sheet 24 faces the shooter with the sheet 22 being positioned at the back side thereof. In such an embodiment, the image of the human being figure would be imprinted on the electronically conductive sheet 24.

In use, the marksman will take a target 12 and hang it against a solid surface or mounted on the stand 14 with the lower end of the upper target portion 18 overlapping the upper end of the lower target portion 20 so that the electrically conductive materials on those target portions will be in contact with one another. through sheets 22. The marksman then fires the two-dart round from the weapon at the target 12 to place both darts within the human figure. Once fired, the marksman will energize the power pack in the weapon to transfer an electric charge through the wire tether or tethers and into the darts. If the marksman has hit the target within the human figure, the tone sound emitted by the weapon would be a pitch that registers identical to a "live" target hit. If the marksman hits the surface 16 not within the human figure, the tone sound would be a pitch that registers as a miss. The conductivity and the tone can only be achieved if both darts are within the human figure where the electrically conductive material is present. The marksman would then reload and fire again in an attempt to place the darts where they will register a hit. The tone that the marksman hears will tell him/her if he or she misses the target.

The target of this invention is designed for electronically controlled devices, stun guns, Taser® or electric pulse type weapons. The electrically conductive material on the target is any type of material that will conduct electrical current when used in conjunction with the target.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. In combination:

a training target including a flexible front sheet, having a front side and a back side, and a flexible back sheet having a front side and a back side;

said flexible back sheet being comprised of an electrically conductive material;

said front side of said flexibie back sheet being adhesively affixed to said back side of said front sheet;

said front sheet being shaped to depict a human being:

said back sheet completely covering said back side of said front sheet;

an electronically controlled weapon capable of firing two darts which are each electrically connected to said weapon by a tether so that said darts may send tones back to said weapon upon said weapon transmitting an electric pulse to the darts after the darts have struck said training target to indicate whether the darts have struck said training target.

2. The combination of claim 1 wherein said training target is comprised of an upper sheet member electrically conductively joined to a lower sheet member.

3. The combination of claim 2 wherein said upper sheet member has a life-sized image of the upper portion of a human being appearing thereon and said lower sheet member has a life-sized image of the lower portion of a human being appearing thereon.

4. The combination of claim 1 wherein said training target is substantially life-sized.

* * * * *